United States Patent [19]

Wilkes et al.

[11] Patent Number: 4,984,334

[45] Date of Patent: Jan. 15, 1991

[54] METHOD AND APPARATUS FOR REMOVING A FIBER FRACTION FROM SEED COTTON

[75] Inventors: Lambert H. Wilkes; Martin Mehner, both of College Station, Tex.; William F. Lalor, Raleigh, N.C.

[73] Assignee: Cotton Incorporated, New York, N.Y.

[21] Appl. No.: 390,719

[22] Filed: Aug. 8, 1989

[51] Int. Cl.[5] ..... D01B 1/06

[52] U.S. Cl. ..... 19/48 R; 19/50; 19/64.5

[58] Field of Search ..... 19/41, 44, 45, 48 R, 19/59

[56] References Cited

U.S. PATENT DOCUMENTS

| | | | |
|---|---|---|---|
| 538,870 | 5/1895 | Faulkner | 19/44 |
| 560,263 | 5/1896 | Faulkner | 19/45 |
| 691,272 | 1/1902 | Kasmeier | 19/41 |
| 821,256 | 5/1906 | Ragsdale | 19/44 |
| 1,257,543 | 2/1918 | Smith | 19/48 R |
| 1,308,823 | 7/1919 | Voorhies | 19/44 |
| 2,639,468 | 5/1953 | Streun | 19/59 |
| 2,973,559 | 12/1958 | O'Neal | 19/59 |
| 3,121,921 | 2/1964 | La Tour | 19/59 |
| 3,172,165 | 7/1965 | Heim | 19/48 R |
| 3,284,855 | 11/1966 | Steimen et al. | 19/48 R |
| 4,441,232 | 4/1984 | Underbrink et al. | 19/48 R |
| 4,934,029 | 6/1990 | Wilkes et al. | 19/48 R |

*Primary Examiner*—Werner H. Schroeder
*Assistant Examiner*—John J. Calvert
*Attorney, Agent, or Firm*—Burns, Doane, Swecker & Mathis

[57] ABSTRACT

An apparatus for removing a fiber fraction from seed cotton includes a plurality of freely rotatable cage rollers that are arranged substantially parallel to one another. The plurality of rollers are rotatable in a continuous path that has a first side for receiving seed cotton. A plurality of nip rollers are positioned in abutting relation to a second side of the continuous path. An arrangement is provided for removing unginned seed cotton and ginned seed from the first side of the continuous path. A reclaiming apparatus is provided for reclaiming unginned seed cotton and discarding ginned seed that has been removed from the first side of the continuous path by the removal arrangement. Also, a conveying device is included for conveying unginned seed cotton that has been reclaimed by the reclaiming apparatus back to the first side of the continuous path.

32 Claims, 3 Drawing Sheets

METHOD AND APPARATUS FOR REMOVING A FIBER FRACTION FROM SEED COTTON

FIELD OF THE INVENTION

The present invention relates to an apparatus and method for processing seed cotton. More particularly, the present invention concerns a method and apparatus for removing fiber fractions from seed cotton.

BACKGROUND OF THE INVENTION

Different types of arrangements have been proposed for ginning seed cotton. In one type of ginning apparatus described in U.S. Pat. No. 4,441,232, which is assigned to the assignee herein, a plurality of cage rollers are rotatably driven in a continuous path. At least one nip roller is positioned in abutting relation to the cage roller on the side of the continuous path opposite to the side that receives the seed cotton. A suction source draws air through the cage rollers and thus, tends to draw at least a portion of the fiber fraction from the seed cotton through the cage rollers. The seed cotton moves in conjunction with the cage rollers as the cage rollers move in their continuous path and the fiber fraction drawn in by the suction is nipped by the nip roller and removed from the apparatus through the suction duct.

Although the apparatus disclosed in the aforementioned patent is effective in removing fiber fractions from the seed cotton, that apparatus is susceptible of certain improvements. The ginning apparatus disclosed in the aforementioned patent is designed in such a manner that the entire outer surface of the cage rollers is utilized for removing lint from the seed cotton. That is, from the point on the outer surface of the cage rollers where the seed cotton is initially deposited to the point where the ginned seed is removed from the outer surface of the cage rollers, the seed cotton is continually subjected to the ginning action of the nip rollers. Thus, although the outer surface of the cage rollers at the point where the seed cotton is initially deposited on the cage rollers is covered to a substantial degree by seed cotton, after the seed cotton has moved along the outer surface of the cage rollers and been subjected to the ginning action of the nip rollers, the seed cotton is thinned out. As a result, a portion of the surface area on the outer surface of the cage rollers becomes uncovered. However, the ginning apparatus is not designed to utilize that uncovered surface area in any particular manner. Moreover, to a certain extent, the uncovered surface area on the cage rollers tends to reduce the suction effect of the suction source, thereby making it more likely that seed cotton will prematurely fall off the outer surface of the cage rollers.

It would be highly desirable, therefore, if that portion of the surface area on the outer surface of the cage rollers that is uncovered and made available through the ginning action of the nip rollers could be put to use in some effective way. A fuller potential of the ginning apparatus could be realized and the efficiency thereby increased if the aforementioned surface area that is made available could be utilized in some manner. Further, the ability of the suction source to hold seed cotton to the outer surface would not be impaired.

Additionally, although the aforementioned ginning apparatus is effective in removing approximately 90–95 percent of the lint from the seed cotton, it would be desirable if the ginning apparatus could be adapted to remove substantially all of the lint from the seed cotton. The removal of substantially all of the lint from the seed cotton would, of course, reduce waste and thereby help increase the cost efficiency associated with operating the ginning apparatus.

Another area in which the performance of the aforementioned ginning apparatus could be improved is with respect to the removal of the seed cotton and the ginned seed from the surface of the cage rollers after the seed cotton has been subjected to the ginning process. Although the aforementioned patent mentions the use of a fan located within the exit duct of the ginning apparatus for increasing the speed and efficiency of the seed cotton removal, that arrangement may not be entirely suitable in that it may be difficult to supply sufficient force to pull all of the seed cotton from the surface of the cage rollers. Accordingly, it would be desirable if a different type of arrangement could be provided for ensuring that all of the seed cotton on the surface of the cage rollers is removed.

OBJECTS AND SUMMARY OF THE INVENTION

In view of the foregoing, it is an object of the present invention to provide an apparatus and method for removing a fiber fraction from seed cotton that is capable of removing substantially all of the lint from the seed cotton.

Another object of the present invention is to provide an apparatus and method for removing a fiber fraction from seed cotton that is adapted to remove all of the unginned seed cotton and ginned seed from the surface of the ginning apparatus.

It is also an object of the present invention to provide an apparatus and method for removing a fiber fraction from seed cotton that is capable of reclaiming the portion of the seed cotton that has not been completely ginned.

It is an additional object of the present invention to provide an apparatus and method for removing a fiber fraction from seed cotton that is adapted to feed the reclaimed seed cotton back to the surface of the ginning apparatus so that all of the lint can be removed from the seed cotton.

It is a further object of the present invention to provide an apparatus and method for removing a fiber fraction from seed cotton that is adapted to feed the reclaimed unginned seed cotton back to the outer surface of the cage rollers at the point where surface area on the outer surface of the cage rollers is made available through the ginning action of the nip rollers.

Those and other objects are accomplished by a method and apparatus according to the present invention. The apparatus includes a plurality of freely rotatable cage rollers arranged substantially parallel to one another. The cage rollers are rotatably driven in a continuous path and the continuous path includes a first side for receiving seed cotton and a second side opposite the first side. A plurality of nip rollers are also provided. Each of the nip rollers has an outer peripheral surface that is positioned in abutting relation to the cage rollers on the second side of the continuous path. The plurality of nip rollers include one nip roller located adjacent the place where seed cotton is deposited on the first side of the continuous path and another nip roller located downstream from the one nip roller in the direction of rotation of the cage rollers. A removal device is located adjacent the another nip roller for removing unginned seed cotton and ginned seed from the first side of the continuous path. In a further aspect of the present invention, the apparatus includes a conveying apparatus for conveying unginned seed cotton that has been retrieved from the first side of the continuous path back to the first side of the continuous path at a point between the first nip roller and the another nip roller.

A method for removing a fiber fraction from seed cotton according to the present invention includes driving a plurality of spaced apart parallel cage rollers along a continuous path whereby the continuous path has a first side for receiving seed cotton and an oppositely located second side that abuts a plurality of nip rollers, depositing seed cotton on the first side of the continuous path adjacent the one nip roller, separating fiber fractions from the seed cotton and removing ginned seed and unginned seed cotton from the first side of the continuous path at a point adjacent the another nip roller. Another aspect of the method according to the present invention includes the step of conveying unginned seed cotton that has been retrieved from the first side of the continuous path adjacent the another nip roller back to the first side of the continuous path at a point between the one nip roller and the another nip roller.

BRIEF DESCRIPTION OF THE DRAWINGS

Preferred embodiments of the present invention will be described in greater detail with reference to the accompanying drawings, wherein like structures bear like reference numerals and wherein.

DETAILED DESCRIPTION OF THE PREFERRED EMBODIMENT

Figure 1:
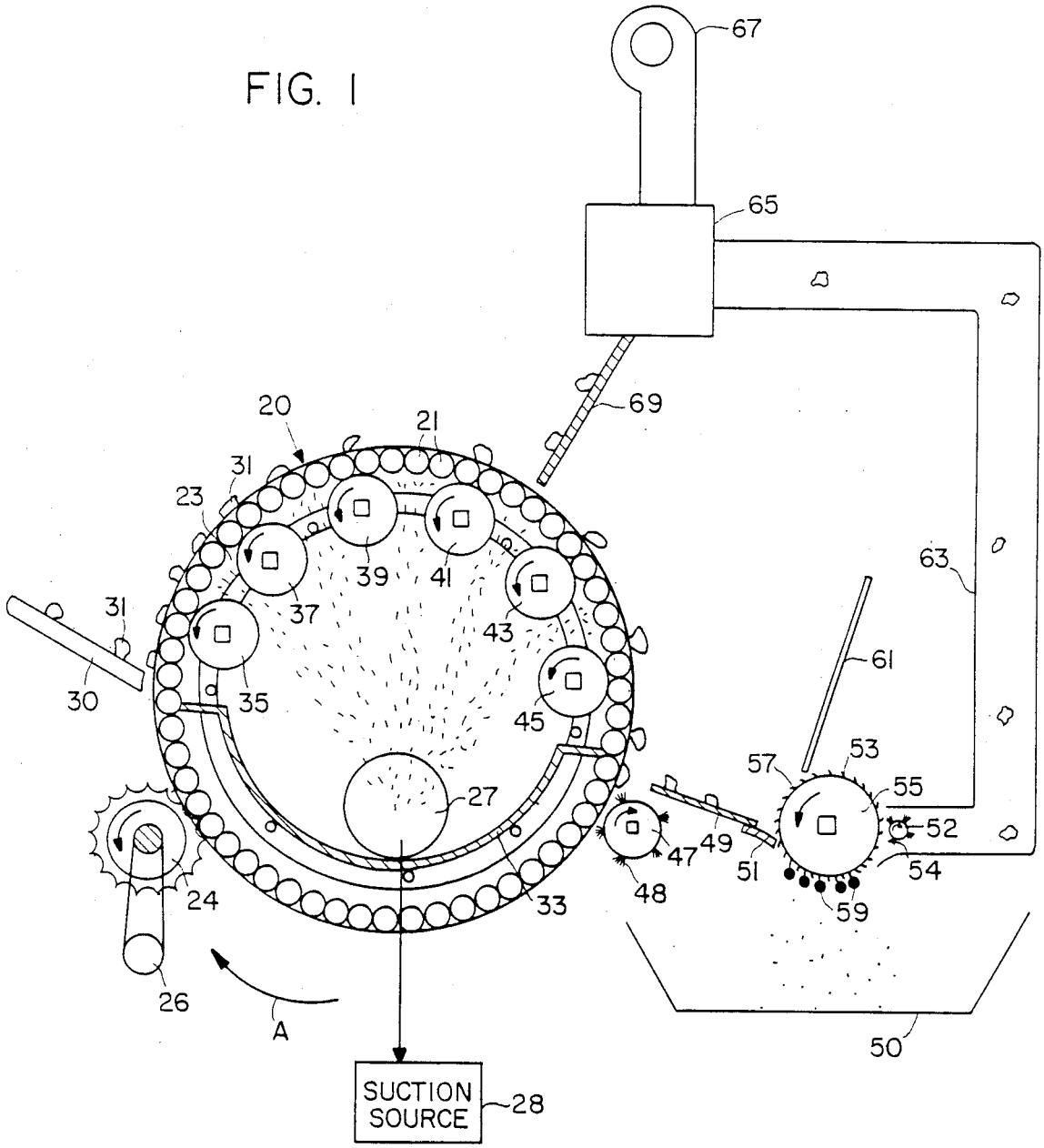
FIG. 1 is a cross-sectional view of an apparatus according to one embodiment of the present invention.

Turning initially to FIG. 1, the apparatus for removing fiber fractions from seed cotton according to the present invention includes a cage roller apparatus 20 having a plurality of individually freely rotatable cage rollers 21 that define a continuous circular path perpendicular to the axis of the rollers 21. The continuous path has an outer surface (i.e., a first side) for receiving seed cotton. The cage rollers 21 are arranged in a closely spaced relationship with respect to one another. The cage rollers 21 are mounted on the inner periphery of a cage 23 and are mounted in a manner such that a small space is maintained between adjacent cage rollers 21.

The cage 23 and the cage rollers 21 are rotated in unison about a longitudinal axis by any suitable device such as a toothed wheel 24 that contacts successive cage rollers 21. The toothed wheel 24 is driven by a suitable driving device 26.

A plurality of nip rollers 35, 37, 39, 41, 43, 45 are positioned within the cage 23. Although the figure depicts six nip rollers, any desired number of nip rollers, more or less than those shown, may be provided. Each of the nip rollers 35, 37, 39, 41, 43, 45 has a diameter that is relatively large in comparison to the diameter of each of the cage rollers 21. The outer cylindrical peripheral surface of each of the nip rollers 35, 37, 39, 41, 43, 45 abuts the inner surface (i.e., a second side) of the continuous path formed by the plurality of cage rollers 21. In that way, the nip rollers exert a force against the cage rollers 21.

One of the nip rollers 35 is positioned adjacent an inclined feed apron 30. The inclined feed apron 30 serves to direct seed cotton 31 that is to be ginned onto the first side of the continuous path (i.e., the outer surface of the cage rollers 21). The other nip rollers 37, 39, 41, 43, 45 are positioned downstream from the one nip roller 35 in the direction of rotation A of the cage rollers 21. Although FIG. 1 depicts an inclined feed apron 30 for directing seed cotton 31 onto the first side of the continuous path, it is to be understood that any suitable type of apparatus could be provided for feeding and directing the seed cotton onto the outer surface of the cage rollers 21.

A duct 27 that is connected to a suitable source of suction 28 is also positioned within the cage 23. The suction source 28 causes a substantially constant quantity of air to be drawn from outside the cage 23. The suction source 28 draws air radially inwardly between the cage rollers 21 and thus, creates a force on the outer surface of the cage rollers 21 that tends to hold objects to the outer surface of the cage rollers 21.

In operation, seed cotton 31 is deposited on the first side of the continuous path formed by the rotating cage rollers 21. The seed cotton 31 is held against the outer surface of the cage rollers 21 by the suction pressure developed on the inside of the cage rollers 21 by the duct 27. The suction force acting on the seed cotton 21 tends to draw at least a portion of the fiber fraction contained in the seed cotton 31 between adjacent cage rollers 21. As the seed cotton 31 moves along with the rotating cage 23, the fiber fraction extending between adjacent cage rollers 21 is nipped by the first nip roller 35 such that the extended fiber fraction is removed from the seed cotton 31. The space between adjacent cage rollers 21 is less than the diameter of the seeds and thus, the fiber fraction can be easily separated from the seed without also pulling the seed through the cage rollers 21. The separated fiber fraction is conveyed by the suction pressure developed within the duct 27 and is removed from the apparatus through the duct 27.

After passing the first nip roller 35, the seed cotton continues moving with the cage 23 and a further fiber fraction may be drawn between adjacent cage rollers 21 as a result of the suction pressure developed in the duct 27. As the seed cotton 31 progresses further around with the cage 23, the extracted fiber fraction will be nipped by the next nip roller 37 and removed from the apparatus through the duct 27.

The seed cotton 31 will continue moving with the cage 23 whereupon another fiber fraction may be drawn between adjacent cage rollers 21 and thereafter, nipped by the next nip roller 39. The above-described operation will continue until the seed cotton 31 passes the last nip roller 45. After passing the last nip roller 45, the seed cotton will be at a position where a tangent to the outer surface of the cage 23 is substantially vertical. At that point, the seed cotton 31 will fall away from the cage rollers 21 due to the force of gravity as well as the presence of an isolation flange 33 which prevents the suction pressure from holding the seed cotton 31 to the cage rollers 21 at that position.

An apparatus and method for removing a fiber fraction from seed cotton of the type described above are disclosed in U.S. Pat. No. 4,441,232, the disclosure of which is hereby incorporated by reference.

With further reference to FIG. 1, the ginning apparatus 20 includes an arrangement for removing ginned seed and unginned seed cotton from the first side of the continuous path. That arrangement includes a brush doffing cylinder 47 that is positioned substantially adjacent to and somewhat downstream from the last nip roller 45 in the direction of rotation A of the cage 23, whereby brushes 48 of the brush doffing cylinder 47 travel counter to and brush the outer surface of the cage rollers 21 and thereby remove unginned seed cotton and ginned seed from the outer peripheral surface of the cage rollers 21. The brush doffing cylinder 47 could be positioned slightly upstream from the position illustrated in FIG. 1 with respect to the direction of rotation A of the cage 23. Rotating the brush doffing cylinder 47 such that its peripheral surface speed is approximately four times greater than the peripheral surface speed of the cage 23 has been determined to give desirable results. A peripheral surface speed of two hundred feet per minute has been found to be suitable for the cage 23.

Positioned adjacent to the brush doffing cylinder 47 is an inclined slide apron 49. The inclined apron 49 serves to direct the ginned seed and unginned seed cotton that has been removed from the outer surface of the cage rollers 21. The ginned seed and unginned seed cotton that is removed from the outer surface of the cage rollers 21 by the brush doffing cylinder 47 is brushed onto the slide apron 49.

Rigidly attached to one end of the inclined slide apron 49 is a wire brush 51. The wire brush 51 presses against the outer peripheral surface of an apparatus that is adapted to reclaim unginned seed cotton and discard ginned seed that has been removed from the first side of the continuous path.

The apparatus for reclaiming unginned seed cotton and discarding ginned seed includes a reclaimer saw 53. The reclaimer saw 53 includes a rotatably driven cylinder 55 having a plurality of saw-toothed blades 57. The saw-toothed blades 57 have teeth extending therefrom and the saw-toothed blades 57 extend outwardly from the cylinder 55. The saw-toothed blades 57 are spaced apart from one another by a distance that is sufficient to permit ginned seed to pass between the saw-toothed blades 57. It has been found desirable to provide a spacing of approximately three-quarters of an inch on center between each of the saw-toothed blades 57. The reclaimer saw 53 rotates in the direction opposite to the direction of rotation of the brush doffing cylinder 47. The stationary wire brush 51 presses against the saw-toothed blades 57 in order to hold the unginned seed cotton against the saw-toothed blades 57 and to help ensure positive attachment of the lint to the saw-toothed blades 57.

Positioned below the reclaimer saw 53 are a plurality of stationary grid bars 59. The stationary grid bars 59 are positioned in close proximity to the outer peripheral surface of the reclaimer saw 53. The grid bars 59 are adapted to keep the unginned seed cotton attached to the saw-toothed blades 57. Also, the grid bars 59 are capable of dislodging ginned seed that may have become entangled in the fibers of the unginned seed cotton.

The spacing between the grid bars 59 and the saw-toothed blades 57, and the spacing between each of the grid bars 59 can be varied in order to accommodate various types of seed cotton having different characteristics (e.g., seed cotton having different seed sizes) and also to accommodate seed cotton which has had differing amounts of lint removed. The grid bars 59 can be adapted to permit the aforementioned spacings to be varied as desired.

A stationary deflector plate 61 is positioned above the reclaimer saw 53. The deflector plate 61 serves to deflect any ginned seed or unginned seed cotton that may fall off the surface of the cage rollers 21. The deflector plate 61 deflects the stray unginned seed cotton and ginned seed to a position in front of the reclaimer saw 53.

A rotating doffing brush 52 may be positioned adjacent the reclaimer saw 53 for purposes of removing seed cotton from the saw-toothed blades 57 of the reclaimer saw 53. The doffing brush 52 is located with respect to the reclaimer saw 53 in such a manner that the brushes 54 extending from the doffing brush 52 contact the saw-toothed blades 57.

The ginning apparatus 20 further includes a conveying system for conveying unginned seed cotton that has been retrieved from the first side of the continuous path. The conveying system includes an air duct 63, a separator 65, a fan 67, and an inclined feed apron 69. One end of the air duct 63 is positioned adjacent the outer peripheral surface of the reclaimer saw 53 and the other end of the air duct 63 is connected to the separator 65. The fan 67 is also connected to the separator 65. The fan 67 pulls air through the separator 65 and the air duct 63 so that unginned seed cotton that has been removed from the saw-toothed blades 57 of the reclaimer saw 53 by the doffing brush 52 is pulled by the air stream produced from the fan 67. Alternatively, it may be desirable to eliminate the doffing brush 52 and thereby rely solely upon the pulling force of the air stream to remove the seed cotton from the saw-toothed blades 57. In either case, the air stream conveys the unginned seed cotton through the air duct 63 and into the separator 65. The separator 65 separates the unginned seed cotton from the air stream and thereafter, the unginned seed cotton is fed down the inclined feed apron 69 back to the outer surface of the cage rollers 21. The inclined feed apron 69 directs the unginned seed cotton back to the outer surface of the cage rollers 21 at a point between the first nip roller 35 and the last nip roller 45.

Although FIG. 1 depicts the feed apron 69 as being positioned between the nip rollers 41 and 43, it is to be understood that the feed apron 69 could be positioned further upstream or downstream from the position illustrated in the direction of rotation A of the cage 23. One of the important considerations with respect to the positioning of the feed apron 96 is that the reclaimed unginned seed cotton be fed back to the outer surface of the cage rollers 21 at a point downstream from the first nip roller 35 with respect to the direction of rotation A of the cage 23.

As mentioned previously, seed cotton 31 is deposited on the outer surface of the cage rollers 31 by way of the feed apron 30 or any other suitable feeding arrangement. The seed cotton is conveyed along the outer surface of the cage rollers 21 while it is subjected to the ginning action of the nip rollers 35, 37, 39, 41, 43, 45. By the time the seed cotton reaches the last nip roller 45, approximately 90–95% of the lint has been removed from the seed. In some cases, all of the lint has been removed from seed so as to result in ginned seed while in other cases, some lint still remains on the seed, thereby resulting in unginned seed cotton. As used in this description, the phrase "unginned seed cotton" refers to seed cotton that has been subjected to the ginning action of the nip rollers but which still has some lint and possibly all of the lint remaining on the seed. On the other hand, the phrase "ginned seed" as used in this description refers to seed that has no or substantially no lint remaining thereon.

When the seed cotton reaches the last nip roller 45, the brush doffing cylinder 47 will brush the unginned seed cotton and the ginned seed off the outer surface of the cage rollers 21 and onto the slide apron 49. Although the force of gravity and the presence of the isolation flange 33 which cuts off the suction force tend to result in the unginned seed cotton falling away from the outer surface of the cage rollers in the manner described above, some of the unginned seed cotton will remain attached to the cage rollers 21. That is because fiber fractions which have been drawn between the cage rollers 21 but which have not been nipped by the nip rollers will tend to hold the unginned seed cotton to the surface of the cage rollers 21. Thus, the rotating brush doffing cylinder 47 removes the unginned seed cotton from the outer surface of the cage rollers 21 and directs the unginned seed cotton to the slide apron 49 where it is fed to the reclaimer saw 53. Similarly, any ginned seed that may be wedged between the cage rollers 21 will be removed by the brush doffing cylinder.

When the unginned seed cotton and the ginned seed reach the reclaimer saw 53, the unginned seed cotton is pressed against the outer peripheral surface of the reclaimer saw 53 by the wire brush 51 so that the lint is firmly attached to the saw-toothed blades 57. Although the ginned seed is also directed down the slide apron 49 to the reclaimer saw 53, the spacing between the saw-toothed blades 57 permits the ginned seed to pass between the saw-toothed blades 57 where it is discarded into a suitable seed collection device 50.

The unginned seed cotton that is attached to the saw-toothed blades 57 passes between the grid bars 59 and the cylinder 55. As the unginned seed cotton passes by the grid bars 59, the lint remains firmly attached to the saw-toothed blades 57. However, any ginned seeds that may have become entangled in the lint of the unginned seed cotton will be advantageously dislodged as the unginned seed cotton passes over the grid bars 59. The spacing between the grid bars 59 permits the dislodged ginned seeds to fall into the seed collection device 50.

When the unginned seed cotton reaches the opening in the duct 63, the stream of air produced by the fan 67 pulls the unginned seed cotton that has been removed from the saw-toothed blades 57 by the rotating doffing brush 52. Alternatively, as mentioned above, the doffing brush 52 can be eliminated and the stream of air produced by the fan 67 can thereby be relied upon to pull the seed cotton from the saw-toothed blades 57 of the reclaimer saw 53. The unginned seed cotton is conveyed through the duct 63, to the separator 65, onto the feed apron 69 and finally, back to the first side of the continuous path formed by the rotating cage rollers 21.

One of the advantages associated with the ginning apparatus according to the present invention is that as the seed cotton 31 is conveyed along the outer surface of the cage 23, fiber fractions are continually removed from the seed cotton through the ginning action of the nip rollers 35, 37, 39, 41, 43, 45. When the seed cotton is first deposited on the outer surface of the cage rollers 21, substantially the entire outer surface of the cage rollers 21 can be covered with the seed cotton. However, as the seed cotton progresses along the cage 23, fiber fractions are removed from the seed cotton 31 so that the amount of seed cotton 31 located on the outer surface of the cage rollers 21 tends to become thinned out. Thus, by the time the seed cotton reaches the third or fourth nip rollers 39, 41, additional room is made available on the outer surface of the cage rollers 21. That surface area that is made available through the ginning action of the nip rollers provides a desirable region for depositing the unginned seed cotton that has been reclaimed from the first side of the continuous path.

It can be seen, therefore, from the foregoing discussion, that the feed apron 69 should be positioned in such a manner that reclaimed unginned seed cotton can be fed back to the outer surface of the cage rollers 21 at a position along the cage where additional surface area on the cage rollers is made available through the ginning action of the nip rollers. It is also evident that the precise position of the feed apron is not absolutely critical, so long as the place where the reclaimed unginned seed cotton is deposited on the outer surface of the cage rollers is located far enough downstream from the area where the seed cotton is initially deposited on the cage rollers 21 that the ginning action of the nip rollers has had an opportunity to gin the seed cotton to an extent necessary to make space available for depositing the reclaimed unginned seed cotton.

Depositing the reclaimed unginned seed cotton at the location described above possesses several advantages over feeding the reclaimed unginned seed cotton back to the feed apron 30. If the reclaimed unginned seed cotton were fed back to the feed apron 30, the reclaimed unginned seed cotton would be competing for ginning space with newly fed seed cotton 31 at the nip rollers 35, 37. Further, feeding the reclaimed unginned seed cotton back to the feed apron 30 would mean that advantage could not be taken of the surface area on the outer surface of the cage rollers that is made available through the ginning action of the nip rollers.

Figure 2:
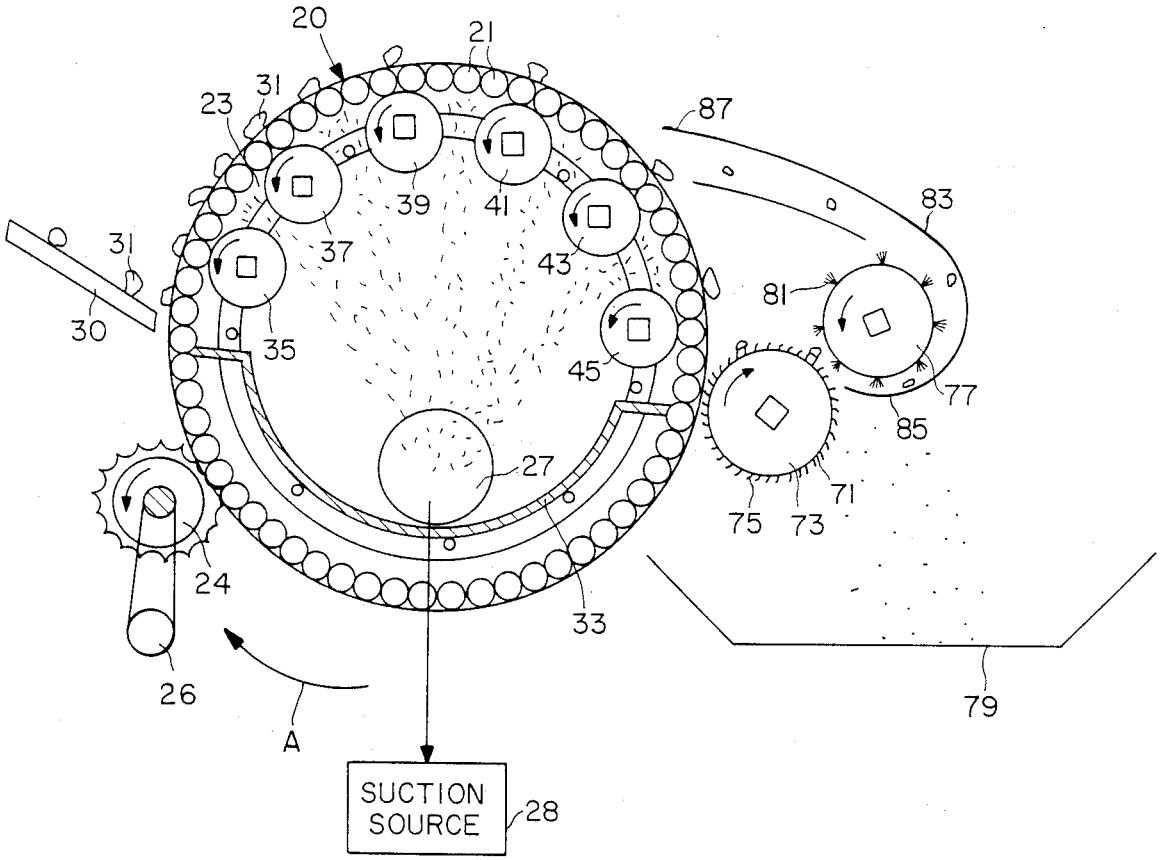
FIG. 2 is a cross-sectional view of an apparatus according to another embodiment of the present invention.

Turning to FIG. 2, another embodiment of the ginning apparatus according to the present invention includes an apparatus 71 for removing unginned seed cotton from the outer surface of the cage rollers 21 and for reclaiming the unginned seed cotton while at the same time discarding the ginned seed. The apparatus 71 includes a rotating cylinder 73 having a plurality of spaced apart saw-toothed blades 75 with teeth extending from the outer peripheral surface thereof. The cylinder 73 rotates in the same direction as the direction of rotation A of the cage rollers 21. Although the saw-toothed blades 75 are located in close proximity to the outer surface of the cage rollers 21, there is a clearance space between the tips of the saw-toothed blades 75 and the outer surface of the cage rollers 21. The saw-toothed blades 75 are spaced apart along the outer peripheral surface of the cylinder 73 by a distance that is sufficient to permit ginned seed to pass between the saw-toothed blades 75.

As the seed cotton moves along the outer surface of the cage rollers 21 and approaches the rotating cylinder 73, the lint on the unginned seed cotton is caught by the saw-toothed blades 75 extending from the outer peripheral surface of the cylinder 73. The unginned seed cotton is thereby attached to the rotating cylinder while the ginned seed having no lint or substantially no lint thereon is discarded into a seed collection device 79.

The embodiment illustrated in FIG. 2 further includes a rotating brush doffing cylinder 77 positioned adjacent to the rotating cylinder 73. The rotating brush doffing cylinder 77 is positioned with respect to the rotating cylinder 73 such that the brushes 81 extending from the outer peripheral surface thereof contact the saw-toothed blades 75 and are able to contact and remove the unginned seed cotton that is attached to the saw-toothed blades 75. The brush doffing cylinder 77 rotates in the direction opposite to the direction of rotation of the cylinder 73. Moreover, the brush doffing cylinder 77 rotates at a greater peripheral speed than the cylinder 73 to ensure adequate removal of unginned seed cotton. Preferably, the peripheral surface speed of the brush doffing cylinder 77 is approximately twice as fast as the peripheral surface speed of the cylinder 73.

A duct 83 serves as an arrangement for conveying the unginned seed cotton that was retrieved and reclaimed from the outer surface of the cage rollers by the rotating cylinder 73 back to the outer surface of the cage rollers 21. The duct 83 has an end portion 85 that partially encircles the rotating brush doffing cylinder 77. The other end 87 of the duct 83 points towards the outer surface of the cage rollers 21. As the rotating brush doffing cylinder 77 rotates and removes unginned seed cotton that is attached to the saw-toothed blades 75 on the rotating cylinder 73, the rotating action of the brush doffing cylinder 77 generates an air current that conveys the unginned seed cotton through the duct 83 and to the outer surface of the cage rollers 21.

The other features of the ginning apparatus illustrated in FIG. 2 ar substantially the same as those described above with respect to FIG. 1 and thus, a description of those features will not be repeated.

According to the second embodiment illustrated in FIG. 2, as the unginned seed cotton and the ginned seed reach the last nip roller 45, the unginned seed cotton will be attached to the saw-toothed blades 75 on the rotating cylinder 73. However, the ginned seed will pass between the saw-toothed blades 75 and be discarded into the seed collection device 79 due to the spacing between the saw-toothed blades as well a the fact that the ginned seed has no lint or substantially no lint associated therewith that can become attached to the saw-toothed blades 75. Thus, the rotating cylinder 73 with the saw-toothed blades 75 serves to remove unginned seed cotton and ginned seed from the outer surface of the cage rollers while also serving to reclaim the unginned seed cotton and discard the ginned seed.

The unginned seed cotton that is attached to the saw-toothed blades 75 is removed from the saw-toothed blades 75 by the rotating brush doffing cylinder 77. The unginned seed cotton is then conveyed through the duct 83 by the air stream that is generated as a result of the rotation of the brush doffing cylinder 77. The unginned seed cotton is deposited on the outer surface of the cage rollers 21 at a point downstream from the place where the seed cotton 31 is initially placed on the cage rollers in the direction of rotation A of the cage 23. The same observations made previously regarding the precise place on the outer surface of the cage rollers that the unginned seed cotton is redeposited are equally applicable here. Thus, it is to be understood that the specific positioning of the duct 83 is not to be construed as being limited to the position shown in FIG. 2.

Figure 3:
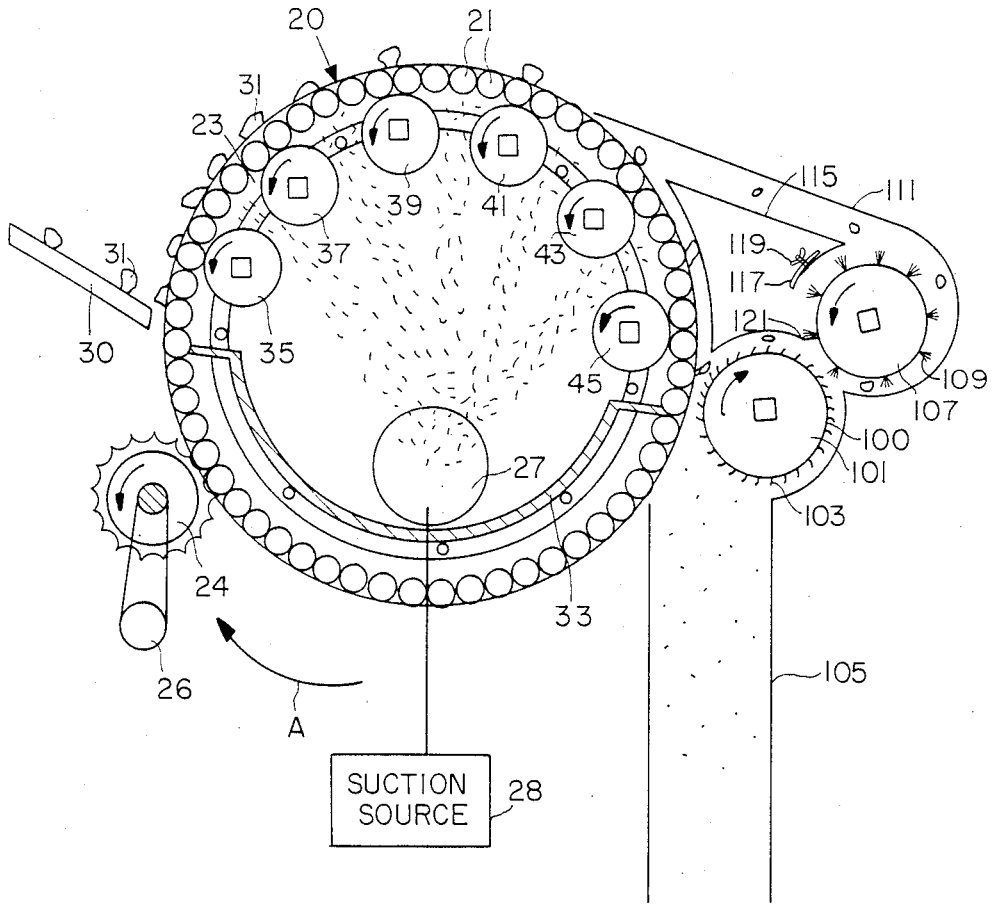
FIG. 3 is a cross-sectional view of an apparatus according to a further embodiment of the present invention.

FIG. 3 illustrates a further embodiment of the ginning apparatus according to the present invention. That further embodiment of the ginning apparatus includes an arrangement of features that is similar to the arrangement illustrated in FIG. 2. In particular, the ginning apparatus includes a rotatably driven arrangement 100 for removing unginned seed cotton from the outer surface of the cage roller 21 and for reclaiming unginned seed cotton while at the same time discarding ginned seed. The arrangement 100 includes a rotatably driven cylinder 101 that has a plurality of saw-toothed blades 103 with teeth extending from the outer peripheral surface thereof. The cylinder 101 rotates in the direction opposite to the direction of rotation A of the cage 23. The saw-toothed blades 103 are separated by a distance that is sufficient to permit ginned seed to pass between the saw-toothed blades 103. The cylinder 101 is arranged with respect to the cage rollers 21 such that the tips of the saw-toothed blades are slightly spaced from the outer peripheral surface of the cage rollers 21. The rotating cylinder 101 is positioned in close proximity with respect to the outer surface of the cage rollers 21 so that as the cylinder 101 rotates, unginned seed cotton located on the outer surface of the cage rollers 21 will become attached to the saw-toothed blades 103. The ginned seed which has no lint or substantially no lint thereon does not become attached to the saw-toothed blades 103. Thus, since the saw-toothed blades 103 are spaced apart from one another by a distance that is sufficient to permit ginned seed to pass between the saw-toothed blades 103, the ginned seed is discarded into a chute 105.

A rotating brush doffing cylinder 107 is positioned adjacent to the rotating cylinder 101. The brush doffing cylinder 107 rotates in the direction opposite to the direction of rotation of the cylinder 101. The brush doffing cylinder 107 rotates at a peripheral surface speed greater than the peripheral surface speed of the cylinder 101 to ensure adequate doffing of unginned seed cotton from the saw-toothed blades 103. Preferably, the brush doffing cylinder 107 should rotate at a peripheral surface speed that is approximately twice the peripheral surface speed of the cylinder 101. The brush doffing cylinder 107 is positioned with respect to the cylinder 101 such that the brushes 109 extending from the outer peripheral surface thereof contact the saw-toothed blades 103 and are able to brush the unginned seed cotton from the saw-toothed blades 103.

As the brush doffing cylinder 107 rotates, an air stream is generated. The generated air stream forces the unginned seed cotton that has been removed from the saw-toothed blades 103 through the duct 111 and to the outer surface of the cage rollers 21.

The embodiment illustrated in FIG. 3 is particularly configured to minimize any effect that the rotating brush doffing cylinder 107 may have on the ability of the ginning apparatus to operate in the most efficient manner. As mentioned above, in the arrangement depicted in FIG. 2, the rotating action of the brush doffing cylinder 77 causes an air current to develop which conveys the unginned seed cotton through the duct 83 and to the outer surface of the cage rollers 21. However, in order to generate that air stream, the rotating brush doffing cylinder 77 must draw air from the interior of the cage 23. Drawing air from the interior of the cage 23 will tend to counteract the force of the suction source 28 which holds the seed cotton to the outer surface of the cage rollers 21. If the counteracting effect of the rotating brush doffing cylinder is great enough, the seed cotton may fall off the outer surface of the cage rollers 21 before the seed cotton has been subjected to the nipping action of all of the nip rollers.

In recognition of that possibility, applicants have developed a further embodiment of the ginning apparatus that offers additional advantages to those associated with the embodiment shown in FIG. 2. In particular, as seen in FIG. 3, the ginning apparatus 20 includes a baffle 115 that prevents air from being drawn from the interior of the cage 23 at the place where the baffle 115 covers the cage 23. While the rotating brush doffing cylinder 107 will still be able to draw air upward from the region where the rotating cylinder 107 is located, that drawing of air will actually help pull the unginned seed cotton from the outer surface of the cage rollers 21 at the point where the unginned seed cotton is to be removed by the rotating cylinder 107.

The baffle 115 includes a slot 121 through which air is drawn for generating the aforementioned air stream that conveys the unginned seed cotton back to the outer surface of the cage rollers 21. The baffle 115 also includes an arrangement for varying the amount of air that is drawn in by the rotating brush doffing cylinder 107. That arrangement includes a movable slide 117 and a tightening device 119. The slide is capable of being moved back and forth across the slot 121 to cover any portion of the slot 121 desired. After the slot 121 has been positioned in the desired place, the tightening device 119, which may be, for example, a wing nut, is tightened in order to fix the position of the slide 117. As an alternative to the wing nut mentioned above, any suitable tightening device could be employed for fixing the position of the slide 117.

The other features illustrated in FIG. 3 are substantially the same as those illustrated with respect to FIG. 1 and thus, the description of those features is not repeated here. Also, except for the fact that the brush doffing cylinder 107 illustrated in the embodiment of FIG. 3 draws air from a different region of the cage than the brush doffing cylinder 77 illustrated in the embodiment of FIG. 2, the manner of operation of the ginning apparatuses depicted in FIGS. 2 and 3 is substantially the same.

The principles, preferred embodiments and modes of operation of the present invention have been described in the foregoing specification. However, the invention which is intended to be produced is not to be construed as limited to the particular embodiments disclosed. The embodiments are to be regarded as illustrative rather than restrictive. Variations and changes may be made by others without departing from the spirit of the present invention. Accordingly, it is expressly intended that all such variations, changes and equivalents which fall within the spirit and scope of the present invention as defined in the claims be embraced thereby.

What is claimed is:

1. An apparatus for removing a fiber fraction from seed cotton comprising:

a plurality of freely rotatable cage rollers arranged substantially parallel to one another, said plurality of cage rollers being rotatably driven in a continuous path, said continuous path having a first side for receiving the seed cotton and a second side opposite said first side;

a plurality of nip rollers, each of which has an outer peripheral surface that is positioned in abutting relation to the cage rollers on the second side of the continuous path to thereby apply a force to the cage rollers, said plurality of nip rollers including one nip roller located adjacent a place where seed cotton is deposited on the first side of the continuous path and another nip roller located downstream from the one nip roller in the direction of rotation of the cage rollers; and rotatable reclaiming means for reclaiming seed cotton that has not been completely ginned so that it can be directed back to the first side of the continuous path and thereby subjected to further fiber fraction removal and for discarding ginned seed having no lint, or substantially no lint thereon.

2. The apparatus according to claim 1, including a rotatable brush doffing cylinder that is arranged adjacent said another nip roller and that is rotatably driven in the same direction as the direction of rotation of said cage rollers for contacting and removing unginned seed cotton and ginned seed from the first side of the continuous path.

3. The apparatus according to claim 1, wherein said reclaiming means includes a rotating cylinder having a plurality of spaced apart saw-toothed blades extending from the outer peripheral surface thereof.

4. The apparatus according to claim 3, including a rotatable brush doffing cylinder positioned adjacent said rotatable cylinder for removing the reclaimed seed cotton that is attached to the saw-toothed blades, and a baffle positioned between the first side of the continuous path and the brush doffing cylinder for preventing air from being drawn from certain regions of the continuous path, said baffle including an opening through which air can be drawn by the rotatable brush doffing cylinder and means covering the opening for varying the size of the opening and the amount of air that can be drawn through the opening by the rotatable brush doffing cylinder.

5. The apparatus according to claim 3, wherein the saw toothed blades are spaced apart a distance that is sufficient to permit the ginned seed to pass between the saw-toothed blades.

6. The apparatus according to claim 3, including a rotatable brush doffing cylinder positioned adjacent said rotating cylinder for removing the reclaimed seed cotton that is attached to the saw-toothed blades.

7. The apparatus according to claim 2, wherein said reclaiming means includes a slide apron and a rotatable reclaimer saw, said reclaimer saw including a cylinder and a plurality of saw-toothed blades extending from the outer surface thereof, said apron being positioned between said brush doffing cylinder and said reclaimer saw for conveying the reclaimed seed cotton and ginned seed that has been removed from the first side of the continuous path to the reclaimer saw.

8. The apparatus according to claim 7, further including conveying means for conveying seed cotton that has been reclaimed by the reclaimer saw back to the first side of the continuous path at a point between the one nip roller and the other nip roller.

9. The apparatus according to claim 8, wherein said conveying means includes an air duct and a fan for drawing air through the air duct, said air duct being positioned adjacent said reclaimer saw so that seed cotton reclaimed by the reclaimer saw is conveyed through the air duct by way of operation of the fan, said conveying means also including a feed apron positioned between an end of the air duct and the first side of the continuous path at a point between the one nip roller and the another nip roller for feeding reclaimed seed cotton from the air duct to the first side of the continuous path.

10. The apparatus according to claim 9, further including a separator positioned between the air duct and the feed apron for separating the reclaimed seed cotton from the conveying air stream.

11. The apparatus according to claim 7, further including a wire brush connected to the end of the slide apron adjacent the reclaimer saw for holding reclaimed seed cotton against the saw-toothed blades of the reclaimer saw, and a plurality of stationary grid bars positioned substantially parallel to the reclaimer saw cylinder and below the reclaimer saw, said plurality of grid bars being positioned relative to the reclaimer saw in such a way that as the reclaimed seed cotton passes between the grid bars and the reclaimer saw, ginned seeds entangled in the reclaimed seed cotton will be dislodged while the reclaimed seed cotton remains attached to the saw-toothed blades.

12. An apparatus for removing a fiber fraction from seed cotton comprising;

a plurality of freely rotatable cage rollers arranged substantially parallel to one another, said plurality of cage rollers being rotatably driven in a continuous path, said continuous path having a first side for receiving the seed cotton and a second side opposite said first side;

a plurality of nip rollers, each of which has an outer peripheral surface that is positioned in abutting relation to the cage rollers on the second side of the continuous path to thereby apply a force to the cage rollers, said plurality of nip rollers including one nip roller located adjacent a place where seed cotton is deposited on the first side of the continuous path and another nip roller located downstream from the one nip roller in the direction of rotation of said cage rollers; and conveying means for conveying unginned seed cotton that has been retrieved from the first side of the continuous path back to the first side of the continuous path at a point between the first nip roller and the another nip roller.

13. The apparatus according to claim 12, wherein said conveying means includes an air duct, a fan for drawing a conveying air stream through the air duct and a feed apron positioned adjacent the air duct, whereby unginned seed cotton retrieved from the first side of the continuous path is conveyed through the air duct by the conveying air stream, is directed to the feed apron and is fed onto the first side of the continuous path.

14. The apparatus according to claim 12, further including removal means movably positioned adjacent said another nip roller for contacting and removing unginned seed cotton and ginned seed from the first side of the continuous path.

15. The apparatus according to claim 14, wherein said removal means includes a rotatable brush doffing cylinder that rotates in the same direction as the direction of rotation of said cage rollers.

16. The apparatus according to claim 14, wherein said removal means includes a rotating cylinder having a plurality of spaced apart saw-toothed blades extending from the outer peripheral surface thereof.

17. The apparatus according to claim 12, further including reclaiming means positioned between said conveying means and the first side of the continuous path for reclaiming ginned seed cotton and discarding ginned seed that has been retrieved from the first side of the continuous path.

18. The apparatus according to claim 17, wherein said reclaiming means includes a rotatable reclaimer saw and a plurality of stationary grid bars, said reclaimer saw including a cylinder and a plurality of saw-toothed blades extending from the outer surface thereof, said grid bars being positioned substantially parallel to the reclaimer saw cylinder and below the reclaimer saw, said plurality of grid bars being positioned relative to the reclaimer saw in such a way that as the unginned seed cotton passes between the grid bars and the reclaimed saw, ginned seeds entangled in the unginned cotton will be dislodged while the unginned cotton remains attached to the saw-toothed blades, wherein a slide apron is positioned between the reclaimer saw and the first side of the continuous path for directing unginned seed cotton and ginned seed that has been retrieved form the first side of the continuous path to the reclaimer saw.

19. The apparatus according to claim 18, further including a wire brush positioned at the end of the slide apron adjacent the reclaimer saw for holding unginned cotton against the saw-toothed blades of the reclaimer saw.

20. The apparatus according to claim 12, wherein said conveying means includes a rotatable brush doffing cylinder and a duct positioned between the first side of the continuous path and the rotatable brush doffing cylinder, said brush doffing cylinder being adapted to generate an air stream as a result of its rotation that is capable of conveying the unginned seed cotton through the duct and to the first side of the continuous path.

21. The apparatus according to claim 20, including a baffle positioned between the brush doffing cylinder and the first side of the continuous path for preventing the brush doffing cylinder from drawing air from certain regions of the continuous path, said baffle having an opening therein through which air can be drawn by the brush doffing cylinder, and means covering the opening for varying the size of the opening and the amount of air that can be drawn through the opening by the brush doffing cylinder.

22. A method of processing seed cotton comprising the steps of:

driving a plurality of spaced apart parallel cage roller along a continuous path, said continuous path having a first side for receiving seed cotton and an oppositely positioned second side that abuts a plurality of nip rollers;

depositing seed cotton on the first side of the continuous path adjacent one nip roller;

removing fiber fractions from the seed cotton; and reclaiming seed cotton that has not been completely ginned so that it can be returned to the first side of the continuous path and thereby subjected to further fiber fraction removal while at the same time discarding ginned seed having no lint, or substantially no lint thereon.

23. The method according to claim 22, wherein said step of reclaiming includes directing unginned seed cotton and ginned seed from the first side of the continuous path, along an inclined side apron and towards a rotating reclaimer saw which includes a cylinder and a plurality of saw-toothed blades extending from the outer peripheral surface thereof, whereby the seed cotton that has not been completely ginned is attached to the saw-toothed blades while the ginned seeds are discarded.

24. The method according to claim 23, further including the step of feeding the reclaimed seed cotton directly to the first side of the continuous path at a point downstream from said one nip roller.

25. The method according to claim 24, wherein the step of feeding the reclaimed seed cotton includes the steps of removing the reclaimed seed cotton from the saw-toothed blades of the reclaimer saw by drawing a stream of air through an air duct, conveying the reclaimed seed cotton through the air duct to an inclined feed apron and directing the reclaimed seed cotton along the feed apron to the first side of the continuous path.

26. The method according to claim 22, including the step of removing ginned seed and unginned seed cotton from the first side of the continuous path at a point adjacent another nip roller by rotating a brush doffing cylinder in close proximity to the first side of the continuous path so that the brush doffing cylinder contacts the ginned seed and unginned seed cotton on the first side of the continuous path, wherein said another nip roller is positioned downstream from the one nip roller in the direction of rotation of the cage rollers.

27. The method according to claim 22, wherein said reclaiming step is performed with the use of a reclaimer saw that includes a rotating cylinder having a plurality of saw-toothed blades extending outwardly therefrom to which the reclaimed seed cotton becomes attached, the method including the step of rotating a brush doffing cylinder in close proximity to the reclaimed saw to remove reclaimed seed cotton that is attached to the saw-toothed blades.

28. A method of processing seed cotton comprising the steps of:

driving a plurality of spaced apart cage rollers a continuous path, said continuous path having a first side for receiving seed cotton and an oppositely positioned second side that abuts a plurality of nip rollers;

depositing seed cotton on the first side of the continuous path adjacent one nip roller;

removing fiber fractions from the seed cotton; and conveying unginned seed cotton that has been retrieved from the first side of the continuous path adjacent another nip roller back to the first side of the continuous path at a point between said one nip roller and said another nip roller, wherein said another nip roller is positioned downstream from the first nip roller in the direction of rotation of said cage rollers.

29. The method according to claim 28, wherein said step of conveying unginned seed cotton includes the steps of drawing an air stream through an air duct in order to pull the unginned seed cotton into the air duct, conveying the unginned seed cotton through the air duct, and directing the unginned seed cotton to the first side of the continuous path.

30. The method according to claim 29, further including the step of reclaiming unginned seed cotton while discarding ginned seed prior to the step of conveying the unginned seed cotton.

31. The method according to claim 30, wherein said step of reclaiming unginned seed cotton includes directing unginned seed cotton and ginned seed from the first side of the continuous path along an inclined slide apron and towards a rotating reclaimer saw which includes a cylinder and a plurality of saw-toothed blades extending from the outer peripheral surface thereof, whereby the unginned seed cotton is attached to the saw-toothed blades and is then drawn from the saw-toothed blades and into the air duct by said air stream.

32. The method according to claim 31, further including the step of removing ginned seed and unginned seed cotton from the first side of the continuous path by rotating a cylinder in close proximity to the first side of the continuous path adjacent said another nip roller so that said cylinder contacts ginned seed and unginned seed cotton on the first side of the continuous path, said removed ginned seed and unginned seed cotton being deposited on said slide apron.

* * * * *